US007771089B2

(12) United States Patent
Schultz et al.

(10) Patent No.: US 7,771,089 B2
(45) Date of Patent: Aug. 10, 2010

(54) HIGH INTENSITY AND LOW POWER SIGNALING DEVICE WITH HEAT DISSIPATION SYSTEM

(75) Inventors: Rodney Schultz, Davisburg, MI (US); Leandro G. Barajas, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 223 days.

(21) Appl. No.: 12/030,984

(22) Filed: Feb. 14, 2008

(65) Prior Publication Data

US 2009/0206756 A1 Aug. 20, 2009

(51) Int. Cl.
*F21V 29/00* (2006.01)

(52) U.S. Cl. ..... 362/294; 362/373

(58) Field of Classification Search ..... 362/294, 362/373, 345, 264, 218, 126, 547, 580
See application file for complete search history.

(56) References Cited

U.S. PATENT DOCUMENTS 4,546,420 A * 10/1985 Wheeler et al. ..... 362/268
7,144,135 B2 * 12/2006 Martin et al. ..... 362/294
2005/0111234 A1 * 5/2005 Martin et al. ..... 362/555
2007/0081337 A1 * 4/2007 Frederico ..... 362/294
2007/0195527 A1 * 8/2007 Russell ..... 362/240

OTHER PUBLICATIONS

Maxim Integrated Products, 2MHZ High-Brightness LED Drivers with High-Side Current Sense and 5000:1 Dimming:, Mar. 2007, 222.maxim-ic.com.
Maxim Integrated Products. "MAX 16820 Evaluation Kit", Mar. 2007, www.maxim-ic.com.
Lumileds Lighting, U.S., LLC., "Luxeon V Star Technical Data DS3-0", Sep. 20, 2004, www.lumileds.com.

* cited by examiner

*Primary Examiner*—Bao Q Truong
(74) *Attorney, Agent, or Firm*—Quinn Law Group, PLLC

(57) ABSTRACT

A luminous signaling device with a heat dissipation system is provided. The heat dissipation system is configured to set up a natural convection current flow to remove air heated by the LED emitter and enable cooler ambient air to flow towards the LED emitter. The signaling device includes a generally tubular element having a hollow inner cavity and a first slot through the tubular element. An LED emitter is operatively connected to the tubular element, with the LED emitter being operable to emit light in response to power. The signaling device includes an electronic driver circuit configured to provide an adjustable current to the LED emitter. Wires connecting the circuit and the LED emitter run through the first slot and the inner cavity of the tubular element.

19 Claims, 2 Drawing Sheets

HIGH INTENSITY AND LOW POWER SIGNALING DEVICE WITH HEAT DISSIPATION SYSTEM

TECHNICAL FIELD

The invention relates in general to a luminous signaling device, with a heat dissipation system configured to set up a natural flow of convection currents.

BACKGROUND OF THE INVENTION

Light emitting diodes (LED) generate a substantial amount of heat while in operation. The heat generated can permanently damage the LED over time, resulting in a shorter life span and output. For the LED to have a high output and long life span, an effective system of heat dissipation is required.

SUMMARY OF THE INVENTION

The invention relates in general to a luminous signaling device, with a heat dissipation system. The signaling device is primarily used in an andon signaling system. The heat dissipation system is configured to set up a natural convection current flow to remove air heated by the LED emitter and enable cooler ambient air to flow towards the LED emitter. The signaling device is preferably configured to use low power and emit high intensity light.

The signaling device includes a generally tubular element having a hollow inner cavity and a first slot through the tubular element. An LED emitter is operatively connected to the tubular element, with the LED emitter being operable to emit light in response to power. The signaling device includes an electronic driver circuit configured to provide an adjustable current or power to the LED emitter. Wires connecting the circuit and the LED emitter run through the first slot and the inner cavity of the tubular element.

In one aspect of the invention, the tubular element is made of a conductive material. In another aspect of the invention, the tubular element includes a second slot through it. A side-emitter lens is operatively connected to the LED emitter. An integrated conductive layer, for absorbing heat, is also operatively connected to the LED emitter. In the preferred embodiment, a high-brightness or high intensity LED emitter is used.

In another aspect of the invention, an annular-shaped heat sink layer, for dissipating heat generated by the LED emitter, is operatively connected to the LED emitter. Thermal conductive paste is applied between the LED emitter and the heat sink layer. The heat sink layer may be operatively connected to or integrally formed with the tubular element. The heat sink layer has an opening configured so that air heated by the LED emitter can flow from the opening in the heat sink layer, into the inner cavity of the tubular element.

In another aspect of the invention, the tubular element is partially fittable into a central aperture of an annular-shaped base. The central aperture extends longitudinally from a first end to a second end of the base. The base is formed with at least one hole that extends longitudinally from the first end to the second end of the base. The central aperture and the hole are open to ambient space at the first end. The hole and central aperture of the base are configured to provide a path for air to flow from ambient space to the tubular element. The first end of the base is operatively connected to a hollow enclosure that has an outer end that is open to ambient space.

In another aspect of the invention, the tubular element includes a tube portion contiguous with a threaded portion. The threaded portion of the tubular element is fittable into the central aperture of the base. In another aspect of the invention, an outer lens is operatively connected to the base, with the outer lens defining an outer cavity around the LED emitter. The outer lens is preferably a Fresnel lens.

In another aspect of the invention, the heat sink layer, the tubular element, and the base are configured so that: (1) air heated by the LED emitter is directed to flow from the opening in the heat sink layer to the inner cavity of the tubular element; and (2) the heated air is directed to flow into ambient space through the central aperture of the base, thereby cooling the LED emitter. The heat sink layer, the tubular element, and the base are configured so that: (1) cooler air from ambient space is directed to flow from the first hole in the base to the outer cavity; (2) the cooler air is directed to enter the inner cavity through the first slot; and (3) the cooler air flows towards the LED emitter through the opening in the heat sink layer, thereby cooling the LED emitter.

In another aspect of the invention, the electronic circuit is configured to provide approximately 400 mA current to the LED device. The circuit includes an inductor of 400 μH and a resistor of 0.499 Ohms. The circuit includes an LED driver, to regulate power to the LED emitter. In another aspect of the invention, the signaling device is partially insertable in a cutout formed in a panel or mountable on a forklift truck. A method of dissipating heat generated by a signaling device is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
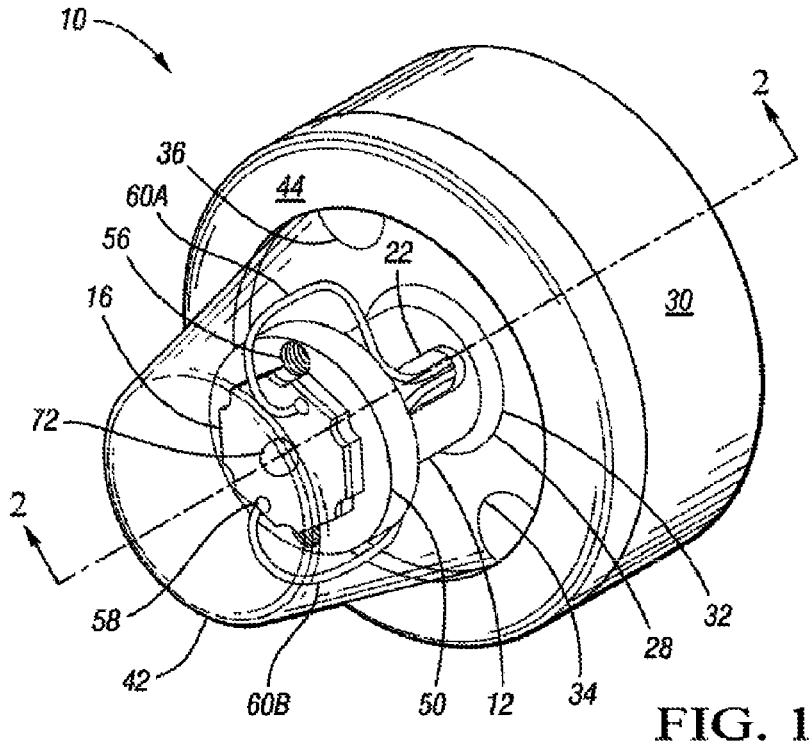
FIG. 1 is a schematic perspective view of a luminous signaling device in accordance with a preferred embodiment of the invention.
Figure 2:
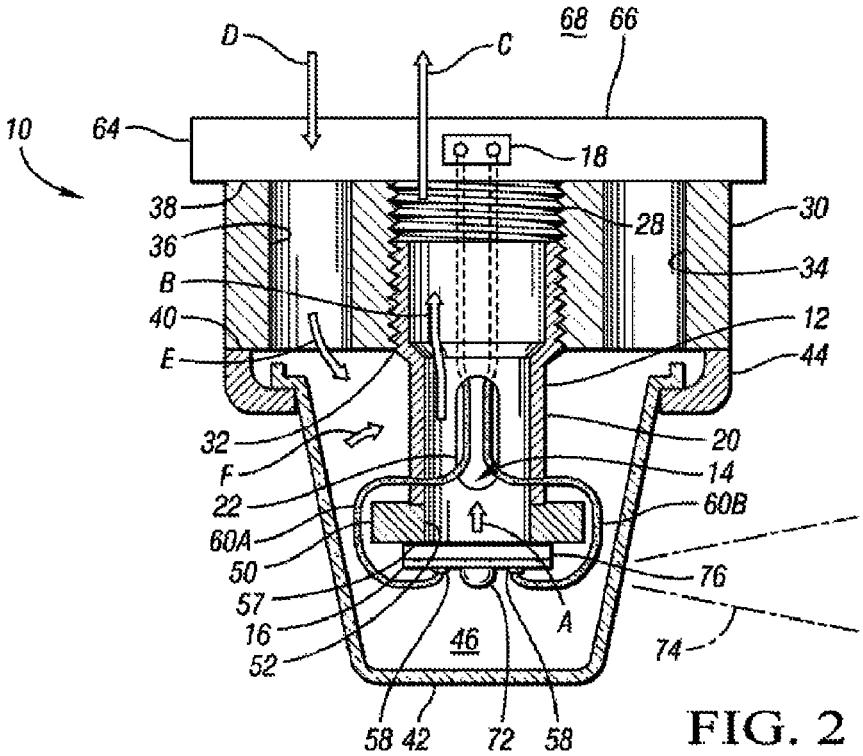
FIG. 2 is a schematic fragmentary partially cross-sectional view of the signaling device taken along line 2-2 shown in FIG. 1.

FIG. 1 shows a schematic perspective view of a luminous signaling device 10 in accordance with a preferred embodiment of the invention. FIG. 2 is a schematic fragmentary partially cross-sectional view of the signaling device 10 taken along line 2-2 shown in FIG. 1.

Figure 3:
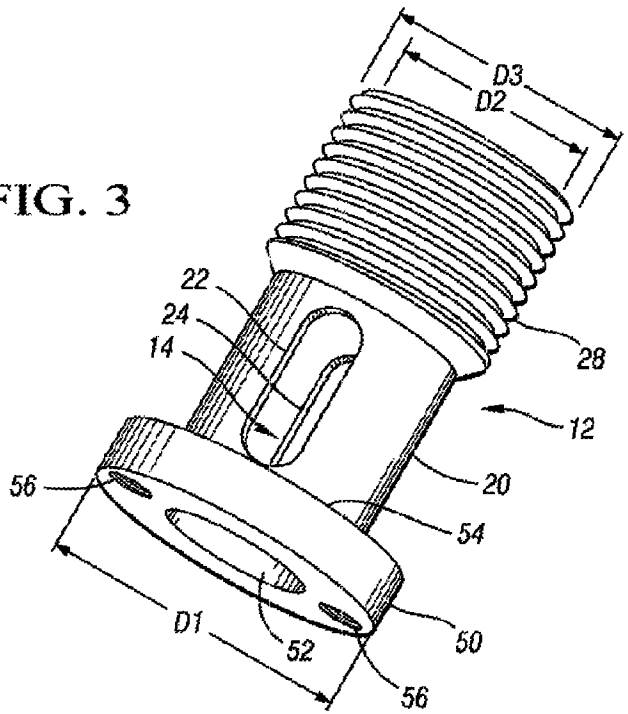
FIG. 3 is a schematic perspective view of a tubular element and a heat sink layer included in the signaling device of FIGS. 1 and 2.

The signaling device 10 includes a generally tubular element 12 with a hollow inner cavity 14. FIG. 3 is a schematic perspective view of the tubular element 12. The tubular element 12 is configured as part of a heat dissipation system, as discussed below. The tubular element 12 is also a support structure for an LED emitter 16 (shown in FIGS. 1-2) that is operatively connected to the tubular element 12. A circuit 18 (shown in FIG. 2 and in detail in FIG. 4) provides power or voltage to the LED emitter 16, which emits light in response.

The tubular element 12 includes a tube portion 20. The tube portion 20 has one or more slots cut through it. FIGS. 1-3 show a first slot 22. The first slot 22 is used both for running wiring and for cooling or ventilation. A second slot 24 is shown in FIG. 3. The tubular element 12 has a threaded portion 28 contiguous with the tube portion 20. The tubular element 12 is preferably made of a metal such as aluminum or copper or other conductive material. In the preferred embodiment, the first slot 22 is oblong and about 1-2 cm. In the preferred embodiment, the diameter D3 of the threaded portion is greater than the diameter D2 of the tube portion 20. Other shapes and dimensions may be used within the scope of the invention.

The threaded portion 28 of the tubular element 12 fits into an annular-shaped base 30, formed with a central aperture 32. The central aperture 32 (shown in FIGS. 1 and 2) of the base 30 is formed with threads complementary to the threads on the threaded portion 28 of the tubular element 12. The threaded portion 28 may also be driven or fitted into the central aperture 32 of the base 30 with a hammer and a dab of epoxy or other suitable material. The base 30 is formed with one or more holes extending longitudinally through the base 30. FIGS. 1 and 2 show a first hole 34 and a second hole 36, extending longitudinally from a first end 38 to a second end 40 of the base 30. The central aperture 32 also extends longitudinally from the first end 38 to the second end 40 of the base 30. The central aperture 32, the first hole 34, and the second hole 36 have access to or are open to ambient space at the first end 38, as discussed below. The base 30 is made of a conductive material such as a metal, for example, aluminum.

An outer lens 42, such as a Fresnel lens, may be attached to the annular-shaped base 30 through a support 44, as shown in FIG. 2. The outer lens 42 defines an outer cavity 46 (see FIG. 2) surrounding the LED emitter 16.

An annular-shaped heat sink layer 50, with an opening 52, is attached to the edge 54 or end of the tube portion 20 of the tubular element 12, shown in FIG. 3, which shows a perspective view of the heat sink layer 50. In the preferred embodiment, an aluminum slug of approximately 10 mm thickness is used for the heat sink layer 50. In an alternative embodiment, the heat sink layer 50 may be integrally formed with the tubular element 12. The heat sink layer 50 has a diameter D1, shown in FIG. 3.

The LED emitter 16 is mounted on the heat sink layer 50 using screws attached at side openings 56 (shown in FIG. 3). Thermal conductive paste, shown at 57, is applied between the LED emitter 16 and the heat sink layer 50. The heat sink layer 50 is made of a conductive material (such as metals) in order to conduct heat away from the LED emitter 16, thus cooling the LED emitter 16.

The LED emitter 16 includes solder pads 58. A first and a second wire 60A, 60B electrically connect to the solder pads 58. The first and second wires 60A, 60B run up through the first slot 22 of the tube portion 20 and into the cavity 14, going up through the cavity 14 and connecting to the circuit 18. The circuit 18 is preferably housed in a hollow enclosure 64 having open ends on both sides. The enclosure 64 is connected to the base 30 at the first end 38 in any suitable manner, for example, with screws. The outer end 66 of the enclosure 64 is open to ambient space, shown at 68. Thus the central aperture 32, the first hole 34, and the second hole 36 have access to or are open to ambient space at the first end 38. The enclosure 64 may have a door (not shown) installed with a hinge (not shown), to allow for access to the components within the enclosure 64.

A side-emitter lens 72 is attached to the LED emitter 16. This type of lens emits light from the side, as shown at 74. Other types of lenses such as a Lambertian lens may also be used. Preferably, the LED emitter 16 is formed with an integrated conductive layer 76 for absorbing heat. In the preferred embodiment, a high-brightness or high intensity LED emitter such as the LUXEON III side-emitter (manufactured by Lumileds Lighting, U.S., LLC, of San Jose, Calif.) is used. However, any type of LED emitter may also be used. The LUXEON III side-emitter has an integrated lens and conductive layer, and delivers 90% intensity of light within a 10 degree optical band.

Heat Dissipation System

Firstly, heat dissipation is provided by a system of natural convection currents. The LED emitter 16 generates heat, thus heating the air surrounding it. The heated air passes through the opening 52 (shown in FIG. 3) in the heat sink layer 50 in the direction of arrow A and enters into the inner cavity 14 of the tubular element 12. The heated air further flows in the direction of arrow B through the inner cavity 14. Arrow C shows the heated air moving into ambient space (shown at 68) through the outer end 66 of the enclosure 64. This creates a low-pressure gradient within the inner cavity 14 of the tubular element 12.

Cooler air from ambient space (shown at 68) at the outer end 66 of the enclosure 64 enters the first and second holes 34, 36 of the base 30 and into the outer cavity 46. FIGS. 1 and 2 show the first and second holes 34, 36 extending from the first end 38 to a second end 40 of the base 30. The cooler air then enters the first and second slots 22, 24 and into the inner cavity 14. This is shown by the sequence of arrows D, E, and F. Thus, the heat sink layer 50, the tubular element 12, and base 30 are configured as part of the heat dissipation system, for cooling the LED emitter 16 through a natural convection current flow.

In summary, air heated by the LED emitter 16 flows from: (1) the opening 52 in the heat sink layer 50; to (2) the inner cavity 14 of the tubular element 12; to (3) the central aperture 32 of the base 30; to (4) ambient space (shown at 68) through the outer end of the enclosure 64. Cooler air from ambient space (shown at 68) at the outer end 66 of the enclosure 64 flows from: (1) the first and second holes 34, 36 of the base 30; to (2) the outer cavity 46; to (3) the first slot 22, entering the inner cavity 14; to (4) the opening 52 in the heat sink layer 50; and into (5) the space adjacent to the LED emitter.

Secondly, the heat generated by the LED emitter 16 is dissipated by conduction through the heat sink layer 50, tubular element 12 and base 30.

Electronic Circuit

The circuit 18 (shown in FIGS. 2 and 4) provides an adjustable source of power or voltage to the LED emitter 16, which emits light in response. The circuit 18 is configured, by using appropriate inductor and resistor values, to preferably deliver low current to the input 82 of the LED emitter 16 in order to prolong the life of the LED emitter 16. While the signaling device 10 is preferably configured to use low current, it may also be used with higher or lower current values.

Figure 4:
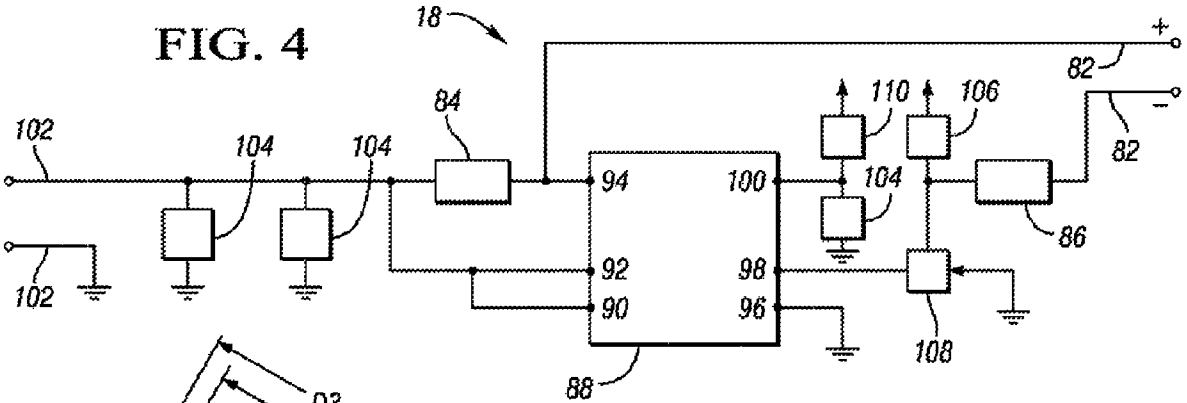
FIG. 4 is a schematic diagram of a circuit providing power to the signaling device shown in FIG. 1.

A schematic diagram of the circuit 18 used in the preferred embodiment is shown in FIG. 4. Approximately 400 mA is delivered to the input 82 of the LED emitter 16. This is about half to one-third of the typical current supplied to an LED emitter. The circuit 18 includes a current sensing resistor 84 and an inductor 86. The resistor 84 has a value of 0.499 ohms and the inductor 86 has a value of 220 micro Henry (μH). The values of 0.499 Ohms and 220 μH are calculated to deliver approximately 400 mA to the input 82 of the LED emitter 16.

The circuit 18 includes an LED driver 88 or chip to regulate power to the LED emitter 16. An efficient LED driver such as MAX16820 (manufactured by MAXIM Integrated Products, Inc. of Sunnyvale, Calif.) is used in the preferred embodiment. Referring to FIG. 4, the LED driver 88 has a plurality of pins 90, 92, 94, 96, 98 and 100 that regulate power and perform other control functions such as dimming and day sensing. The circuit 18 and LED driver 88 are designed to operate from a 4.5V to 28V power supply. The circuit 18 also includes input terminals 102 connected to the power supply, capacitors 104 (of approximately 1 μF), a diode 106, a switch 108, another resistor 110 and connections to ground.

Figure 5:
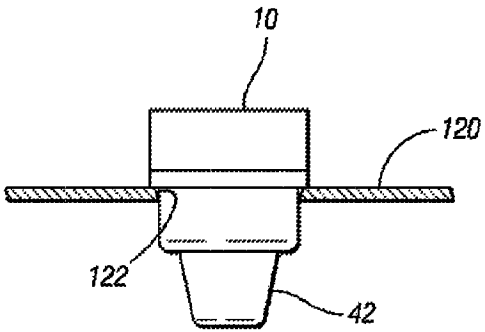
FIG. 5 is a schematic side view illustration of the signaling device partially inserted in a panel.

The signaling device 10 is primarily used in an andon signaling system. FIG. 5 shows a panel 120 having a cutout 122 or hole. The signaling device 10 is partially insertable in the cutout, with the outer lens 42 sticking or jutting out of the panel 120. A plurality of signaling devices emitting light of different colors may be arranged together in a panel with multiple cutouts to form a multi-colored sign or display panel.

The signaling device 10 may also be used as a forklift truck signaling device, in information panels or signs, as part of interior and exterior lighting for commercial automotive applications, LCD backlighting, radio antenna safety signaling and traffic signals. For example, signaling device 10 may be mounted on a forklift truck (not shown) and attached to a programmable controller. The enclosure 64 of the signaling device 10 may be mechanically mounted to the side of the truck. The controller may be programmed to pulse the power supplied to the signaling device such that the signaling device is on when the truck moves forward and blinks when the truck moves in reverse.

While the best modes for carrying out the invention have been described in detail, those familiar with the art to which this invention relates will recognize various alternative designs and embodiments for practicing the invention within the scope of the appended claims.

The invention claimed is:

1. A luminous signaling device with a heat dissipation system, comprising:

a generally tubular element having a hollow inner cavity and a first slot through said tubular element;

an LED emitter operatively connected to said tubular element, said LED emitter being operable to emit light in response to power;

an electronic circuit configured to provide power to said LED emitter;

at least one wire connecting said circuit and said LED emitter, said at least one wire passing through said first slot into said inner cavity of said tubular element; and wherein said heat dissipation system is configured to provide a natural convection current such that air heated by said LED emitter flows out through said inner cavity, leading cooler air to enter said inner cavity through said first slot.

2. The device of claim 1, wherein said tubular element is made of a conductive material.

3. The device of claim 1, further comprising a second slot through said tubular element.

4. The device of claim 1, further comprising:

a side-emitter lens operatively connected to said LED emitter; and an integrated conductive layer operatively connected to said LED emitter, for absorbing heat.

5. The device of claim 1, further comprising:

an annular-shaped heat sink layer operatively connected to said LED emitter, for dissipating heat generated by said LED emitter;

thermal conductive paste applied between said LED emitter and said heat sink layer; and said heat sink layer being integrally formed with said tubular element and having an opening configured such that air heated by said LED emitter flows from said opening in said heat sink layer to said inner cavity of said tubular element.

6. The device of claim 1, further comprising:

an annular-shaped heat sink layer operatively connected to said LED emitter, for dissipating heat generated by said LED emitter;

thermal conductive paste applied between said LED emitter and said heat sink layer; and said heat sink layer being operatively connected to said tubular element and having an opening configured such that air heated by said LED emitter flows from said opening in said heat sink layer to said inner cavity of said tubular element.

7. The device of claim 6, further comprising:

an annular-shaped base having a central aperture extending longitudinally from a first end to a second end of said base, said central aperture being configured such that said tubular element is partially fittable into said central aperture;

at least one hole formed in said base and extending longitudinally from said first end to said second end of said base;

said central aperture and said hole being open to ambient space at said first end; and wherein said central aperture and said hole are configured to provide a path for air to flow from ambient space to said tubular element.

8. The device of claim 7, wherein:

said tubular element includes a tube portion contiguous with a threaded portion; and said threaded portion of said tubular element is fittable into said central aperture of said base.

9. The device of claim 7, further comprising an outer lens operatively connected to said base, said outer lens defining an outer cavity around said LED emitter.

10. The device of claim 9, wherein said outer lens is a Fresnel lens.

11. The device of claim 9, further comprising a hollow enclosure operatively connected to said first end of said base, said enclosure having an outer end that is open to said ambient space.

12. The device of claim 11, wherein said heat sink layer, said tubular element, and said base are configured such that:

air heated by said LED emitter is directed to flow from said opening in said heat sink layer to said inner cavity of said tubular element; and said heated air is directed to flow into said ambient space through said central aperture of said base, thereby cooling said LED emitter.

13. The device of claim 12, wherein said heat sink layer, said tubular element, and said base are configured such that:

cooler air from said ambient space is directed to flow from said first hole in said base to said outer cavity;

said cooler air is directed to enter said inner cavity through said first slot; and said cooler air flows towards said LED emitter through said opening in the heat sink layer, thereby cooling said LED emitter.

14. The device of claim 1, wherein said circuit is configured to provide approximately 400 mA current to said LED device.

15. The device of claim 14, wherein said circuit includes an inductor of 400 μH and a resistor of 0.499 Ohms.

16. The device of claim 14, wherein said circuit includes an LED driver, to regulate power to said LED emitter.

17. The device of claim 1, further comprising:

a panel having a cutout; and wherein said device is partially insertable into said cutout in said panel.

18. The device of claim 1, wherein said device is mountable on a forklift truck.

19. A method of dissipating heat generated by a signaling device including an LED emitter, the method comprising:

providing a generally tubular element having a hollow inner cavity and a first slot through the tubular element, the LED emitter being operatively connected to the tubular element;

configuring the signaling device to provide a path for air heated by said LED emitter to flow to ambient space;

configuring the signaling device to provide a path for cooler air from said ambient space to enter the inner cavity through the first slot; and operatively connecting an electronic circuit to the LED emitter through at least one wire, said at least one wire passing through the first slot of the tubular element.

* * * * *